US010720254B1

(12) United States Patent
Degtiarenko et al.

(10) Patent No.: US 10,720,254 B1
(45) Date of Patent: Jul. 21, 2020

(54) PRODUCTION OF RADIOACTIVE ISOTOPE CU-67 FROM GALLIUM TARGETS AT ELECTRON ACCELERATORS

(71) Applicant: Jefferson Science Associates, LLC, Newport News, VA (US)

(72) Inventors: Pavel V. Degtiarenko, Williamsburg, VA (US); Giorgi Kharashvili, Newport News, VA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 478 days.

(21) Appl. No.: 15/441,204

(22) Filed: Feb. 23, 2017

(51) Int. Cl.
*G21G 1/00* (2006.01)
*H05G 2/00* (2006.01)
*G21G 1/12* (2006.01)

(52) U.S. Cl.
CPC ..... *G21G 1/001* (2013.01); *G21G 1/12* (2013.01); *H05G 2/00* (2013.01); *G21G 2001/0094* (2013.01)

(58) Field of Classification Search
CPC .. G21G 1/001; G21G 1/12; G21G 2001/0094; H05G 2/00
USPC ..... 376/190, 202
See application file for complete search history.

(56) References Cited

U.S. PATENT DOCUMENTS 4,953,191 A * 8/1990 Smither ..... H01J 35/08 378/130
6,638,490 B2 * 10/2003 Jamriska ..... G21G 1/10 376/190

OTHER PUBLICATIONS

Masumoto, "Photon Activation Analysis", Encyclopedia of Analytical Chemistry, Sep. 15, 2006, pp. 1-25. (Year: 2006).*
Ricci, "Sensitivities for photon activation analysis with thick-target, 110-MeV electron bremsstrahlung", Analytical Chemistry 46, No. 4 (Apr. 1974): 615-618. (Year: 1974).*
Smith, "The production, separation, and use of 67Cu for radioimmunotherapy: a review", Applied Radiation and Isotopes 70, No. 10 (Oct. 2012): 2377-2383. (Year: 2012).*
Fritzberg, "Metallic radionuclides for radioinnnnunotherapy", Radioimmunotherapy of Cancer, Marcel Dekker, Inc., New York (Jul. 2000): 57-79. (Year: 2000).*

* cited by examiner

*Primary Examiner* — Jack W Keith
*Assistant Examiner* — Daniel Wasil

(57) ABSTRACT

A system and process for the photo-nuclear production of $^{67}$Cu using mainly the $^{71}$Ga (γ, α)$^{67}$Cu reaction. The system and process uses a high energy electron beam, with or without a radiator, in order to isotopically convert at least a portion of a liquid $^{71}$Ga target to $^{67}$Cu.

7 Claims, 1 Drawing Sheet

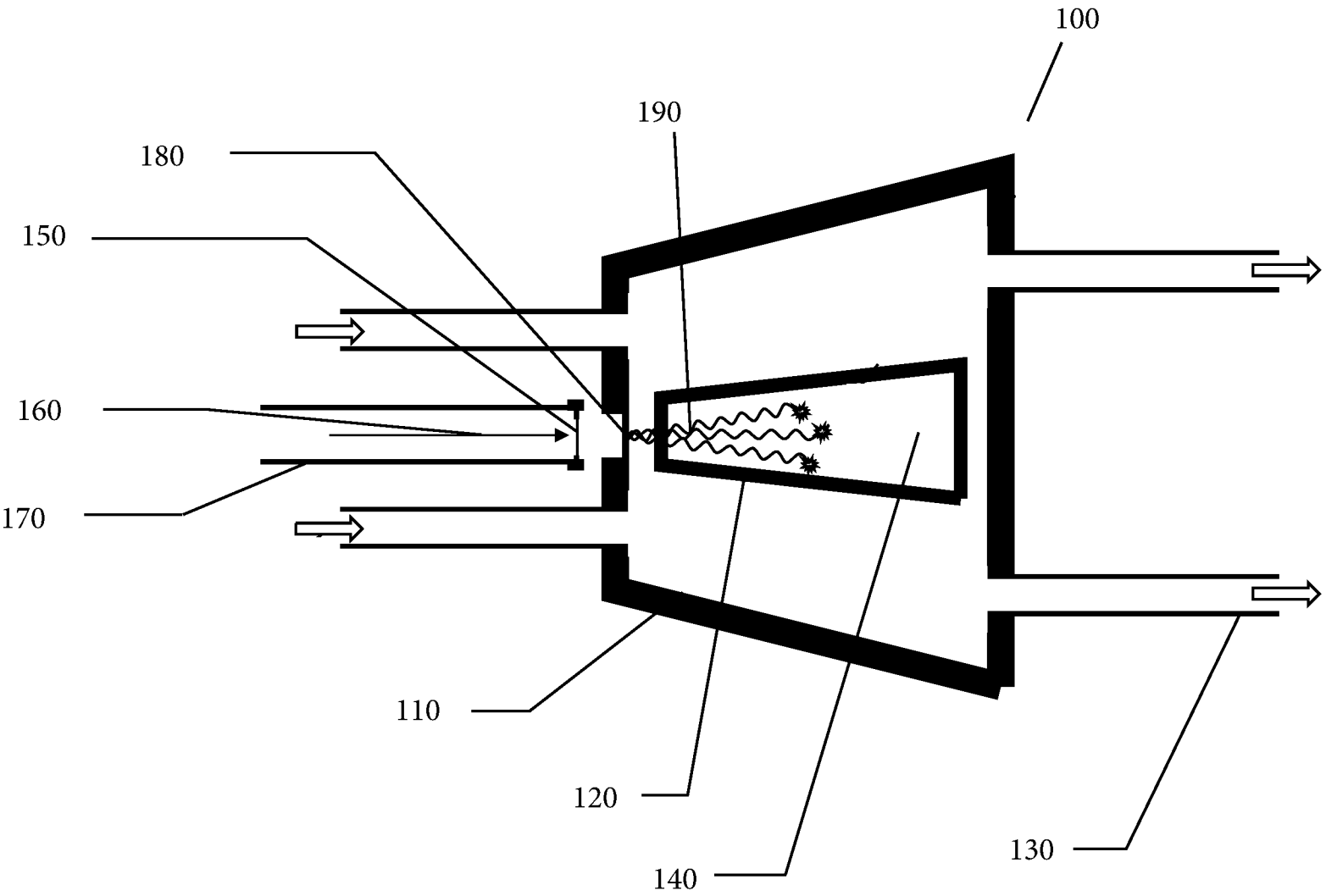
100
190
180
150
160
170
110
120
140
130

PRODUCTION OF RADIOACTIVE ISOTOPE CU-67 FROM GALLIUM TARGETS AT ELECTRON ACCELERATORS

The United States Government may have certain rights to this invention under Management and Operating Contract No. DE-AC05-06OR23177 from the Department of Energy.

FIELD OF THE INVENTION

The present invention relates to the production of radioactive isotopes, and, more specifically, methods of producing radioactive isotopes using an electron accelerator.

BACKGROUND OF THE INVENTION

The use of radioactive isotopes in research and medicine is a multi-billion dollar industry that serves nearly twenty million Americans each year in nuclear medical procedures. It also serves an essential function in the nation's nuclear security and nuclear research. Numerous reports extensively document the national need for research radioisotopes, especially for both beta/gamma particle emitters and alpha particle emitters.

$^{67}$Cu is a valuable isotope with both beta and gamma emissions which are extremely useful for image-guided radiopharmaceutical therapy. Among other valued characteristics, it emits both therapeutic and imaging radiation and has been approved for trials with human patients. Even though the use of this isotope in radiopharmaceutical therapy is highly advantageous, research with $^{67}$Cu has been hampered by the limited availability of the isotope. The limited supply of certain $^{67}$ radioisotopes, including Cu, is a fundamental limiting factor in many biomedical research programs that are exploring targeted treatment with radioisotopes. The nation's supply of such isotopes is reliant upon a scant number of production facilities utilizing very few production processes.

Radioactive nuclides can be produced through radioactivation of a target using any radiation that carries sufficient energy to induce nuclear breakup. The vast majority of isotopes used in research are produced by research nuclear reactors. Aside from a paucity of such facilities, more than half of the research reactors involved in isotope production are forty years old or older. Accordingly, no robust sources of these isotopes exist in the Unites States today. Novel ways of producing research isotopes for medical and other purposes are necessary to address the issues of (i) the inability of reactors to produce certain isotopes, e.g., proton-rich isotopes, and (ii) the production of isotopes currently in short supply, and (iii) the potentially impending shortage of isotopes as ageing reactors are shut down.

One potential solution is to focus upon electron accelerators. When coupled to sub-critical assemblies, electron accelerators are capable of producing large quantities of both neutron-rich and proton-rich radioisotopes. High power electron accelerators are well suited for the production of some important isotopes for medical and industrial applications.

Accordingly, new methods of isotope production suitable for electron accelerators and corresponding new processing technologies are necessary in order to make more isotopes available for research and other applications.

BRIEF SUMMARY OF THE INVENTION

The present invention comprises a system and process for the photo-nuclear production of $^{67}$Cu using mainly the $^{71}$Ga ($\gamma$, $\alpha$)$^{67}$Cu reaction. The system and process uses a high energy electron beam, with or without a radiator, to generate photons in order to isotopically convert at least a portion of a liquid gallium-71 target to copper-67.

The system and method may be used to create a supply of certain radioisotopes, including $^{67}$Cu, at a reasonable cost and on a larger scale than is currently in practice. A preferred embodiment of this method uses a radiator, which is physically isolated from the isotope production target, to generate photons.

More specifically, in the preferred embodiment, a radiator, composed of a high Z material such as tungsten, is struck with a beam from a high power electron linac. Bremsstrahlung photon emissions are then focused on a target downstream of the radiator.

A thick liquid gallium target is used when producing $^{67}$Cu via the $^{71}$Ga ($\gamma$, $\alpha$)$^{67}$Cu reaction. Unlike the $^{67}$Cu production methods by zinc activation, this method permits higher power irradiation, easier separation of the resulting copper from the target or other converted products within the target using the chemical differences of the materials, and results in a radiologically pure final product.

BRIEF DESCRIPTION OF THE DRAWINGS

FIG. 1 is a view of the target assembly in operation.

DETAILED DESCRIPTION

The present invention is a method of photo-nuclear production using a source of high energy photons emitted from a bremsstrahlung source powered by an electron linear accelerator. The principal embodiment operates at nuclear excitation energies in the 20-100 MeV region and results in the production of $^{67}$Cu via the $^{71}$Ga ($\gamma$, $\alpha$)$^{67}$Cu photo-nuclear reaction.

The fundamental production mechanism set forth herein involves photo-nuclear reactions at giant dipole resonance energies (nuclear excitation energies in the 30-50 MeV region). Historically, this production mechanism has been discounted because of the difficulties in separating chemically-identical species that are produced from the prevalent ($\gamma$, n) reactions in the original target, which results in a low specific activity of the final product.

High power (~100 kW) electron accelerators are well suited for the production of various isotopes. One method of producing isotopes at electron accelerators is using a high Z radiator to generate bremsstrahlung photons, which in turn irradiate the target. A large fraction of the electron energy in such setup is converted into the photon flux, thus making the irradiation of the lower Z targets significantly more efficient, as compared with the case when a lower Z target is irradiated directly by the electron beam. In addition to that advantage, the use of such radiator generates photons in a material that is physically isolated from the isotope production target and makes the heat management simpler.

In general, photo-nuclear resonant cross sections have large widths. This feature, in conjunction with the large flux of photons that can be produced at high power electron accelerators, enables substantial yields of desired isotopes by photo-production because the yields are proportional to the integral of the flux and the cross section. In addition, the high penetrating power of photons enables much thicker targets than can be used with proton beams of comparable energy, which further boosts photo-nuclear yields, and alleviates some of the heating and corrosion issues encountered when using high power density proton beams.

Higher activity yields may be obtained by raising the average current of the photon-producing beam as high as achievable. Electron beam energies over the range of 20 MeV to 100 MeV are suitable for photonuclear production of various isotopes. The output energy of the accelerator produced electron radiation should be optimized such that it is sufficiently high to produce the desired activity but low enough to limit the production of undesired radionuclides through other competing reactions. The energy range for $^{67}$Cu production with a $^{71}$Ga target is optimal at 30-50 MeV. The exposure time necessary would be based upon the other process parameters, e.g. beam energy and target thickness, and the desired quantity of the selected isotope.

In a preferred embodiment, the electron beam would first strike and interact with a high-Z radiator. This produces the flux of the energetic photons in the radiator which then strike the target. The bremsstrahlung converter or radiator is composed of a material such as tungsten or tantalum which has the necessary properties of a high conversion rate of electrons to photons and such other properties as to be able to withstand high power densities and accompanying temperature excursions.

The parameters and optimization of the radiator are critical as they directly affect the dissipation of the electron energy, the cooling of the radiator, and the attenuation of the appropriate energy photons intended for the target. Among such parameters are the composition of the radiator, the thickness of the radiator, and the distance between the radiator and the target.

In a second embodiment, the electron beam would directly impinge upon the target and go through it, without first striking a radiator/convertor. A portion of the beam would be converted to energetic photons which would continue to go through the target and produce the desired isotope.

When producing $^{67}$Cu, a thick liquid gallium (Ga) target is used. Gallium has a high boiling point (2200 deg. C.) and a low melting point (30 deg. C.). The high boiling point makes it an attractive target which can handle high beam power for an extended period of time.

The target design must be optimized as well. The target is subject to irradiation by photons of energies sufficient to cause nuclear conversions and, also, irradiation by photons and electrons of insufficient energy to cause conversions. The target must accommodate all of this incident energy. Therefore, the characteristics of the target must be managed to avoid boiling the target material or inducing unwanted chemical or radiolytic reactions in the material. Since Gallium does not boil nor tungsten melt at any reasonably achievable temperature during this process, the target can be directly exposed to the electron beam during irradiation, simplifying the design. The target must be thick enough to have a noticeable probability for the energetic photons to interact in it and produce the desired isotope. Ideally, a gallium target would be maintained between 30° and 2000° C. with low vapor pressure. It is further preferable to use a target which is enriched in the isotope of interest, e.g., $^{71}$Ga as an enriched target increases the yield of the $^{67}$Cu photoproduction process and reduces contaminating species.

The target is mounted in a target apparatus. FIG. 1 illustrates the target apparatus in operation. High beam power requires targets and cooling systems that can adequately handle power dissipation. In a preferred embodiment, the target apparatus 100 consists of a jacket and a target holder 120. In one embodiment, a copper cooling jacket having a clam-shell design is used. The jacket 110 has a plurality of water cooling channels 130 which run through the body of the jacket. This embodiment relies upon the use of a Boron Nitride (BN) cylinder 120 to hold the gallium target 140. The use of BN prevents contamination of the target, i.e., the cylinder is positioned within the jacket and holds the gallium target in order to avoid copper contamination. The cylinder 120 may, however, be composed of any suitable material which has a high melting point (generally in excess of 3,000° C.) and a high thermal conductivity. The preferred embodiment discussed herein would incorporate hexagonal BN which has a higher thermal conductivity.

The gallium target is completely encased within the BN cylinder. The clam shell design of the copper jacket facilitates the installation and removal of the cylinder. The target apparatus is designed such that sufficient thermal contact between the BN cylinder and the copper jacket is maintained.

FIG. 1 also illustrates the electron beam 160, beam pipe 170, radiator 180 and photons 190 when in operation. Certain parameters of the target assembly may vary but a preferred embodiment would incorporate a BN cylinder with a radius of 10 mm and a length of 100 mm. The water flow rate through the water cooling channels would be 5 GPM per channel. This configuration would accommodate at least 50 kW of total beam power.

The electron beam exit window 150 must be able to handle the current density of the beam without losing its thermal and structural integrity. Beryllium is preferable due to its high melting point (1287° C.) and low density. A Be exit window should have sufficient heat handling capacity to maintain its integrity.

A Be window of 6.35 cm aperture and 380 μm thickness is satisfactory as it will withstand 1 mA of current and hold accelerator vacuum when the flange and the window are cooled and the electron beam diameter is at least 12 mm. Cooling of the flange can be accomplished by circulating water and cooling of the window can be accomplished by a modest flow of (1 m/s) of nitrogen gas. Applying an appropriate beam optics configuration, it is possible to create a 12 mm beam spot on the window. Modification of the thickness and cooling arrangements would allow the window to accept higher beam currents.

Photon irradiation of natural gallium target (60% $^{69}$Ga/40% $^{71}$Ga) leads to the production of $^{67}$Cu mainly by the $^{71}$Ga(γ, α) reaction and, depending on photon energy, there will also be a contribution from $^{69}$Ga(γ, 2p) reaction, albeit at a much lower level. Irradiation of natural Ga target will also lead to the production of Ga, Zn and Cu isotopes, including $^{63}$Cu, $^{64}$Cu, and $^{65}$Cu by various reactions of gammas and neutrons on the target isotope, such as the $^{69}$Ga(γ, α) reaction. Production of undesired copper isotopes and other unwanted radioactivity will be greatly minimized when an enriched $^{71}$Ga target is used, leading to significant increase in the specific activity and radiological purity of produced $^{67}$Cu. Lower beam energy, approximately 40 MeV, produces fewer contaminants at a reasonable $^{67}$Cu production while a higher beam energy, e.g., 100 MeV, has a higher $^{67}$Cu yield albeit with higher degree of contamination.

Following the irradiation process, isotope separation and purification must be completed. Radiochemical separation of $^{67}$Cu from targets is performed using a combination of solvent extraction and ion-exchange chromatography. As noted earlier, production of other Cu isotopes is minimized when an enriched $^{71}$Ga target is used, leading to a significant increase in the specific activity and radiological purity of produced $^{67}$Cu.

As also noted above, the production mechanisms involving photo-nuclear reactions at giant dipole resonance energies have been historically discounted because of the difficulties in separating chemically-identical species that are produced from (γ, n) reactions in the original target. The method set forth herein focuses on the production of species that differ chemically from the target, which are produced from (γ, charged-particle) reactions. These photo-nuclear reactions create daughter species with a different atomic number from the target. This makes chemical separation more feasible and, commensurately, high specific activity can be achieved.

One embodiment, using an electron beam having an energy of approximately 40 MeV and 50 kW of power, in conjunction with target of commercially available 99.9999% pure $^{71}$Ga, would result in a $^{67}$Cu production rate of at least 0.6 mCi/kW-h and a final product having a specific activity of 5.6 Ci/microgram or greater. Further, after separation, at least ninety-nine percent of the radioactive copper would be made up of $^{67}$Cu.

While the invention has been described in reference to certain preferred embodiments, it will be readily apparent to one of ordinary skill in the art that certain modifications or variations may be made to the system without departing from the scope of invention claimed below and described in the foregoing specification.

What is claimed is:

1. A method of producing radioactive isotope copper-67 comprising:

providing a target in liquid form comprising gallium-71;

directing an electron beam onto a bremsstrahlung converter in order to generate photons;

said electron beam having a beam energy of at least 30 MeV; and, irradiating said target with said photons in order to isotopically convert at least a portion of the target to copper-67; and, radiochemically separating the copper in the target from other elements in the target, wherein no less than ninety nine percent of the radioactive copper is made up of copper-67.

2. The method of claim 1 wherein said electron beam has an energy of at least 100 MeV.

3. The method of claim 1 wherein said converter is composed of either tungsten or tantalum.

4. The method of claim 1 wherein said copper has a specific copper-67 activity of at least 5.6 Ci/microgram.

5. The method of claim 1 wherein said electron beam has an average energy of 40 MeV and an average power of 50 kW.

6. The method of claim 5 wherein said copper-67 has a specific activity of at least 5.6 Ci/microgram.

7. A method of producing radioactive isotope copper-67 comprising:

providing a target comprising gallium-71 in liquid form;

positioning said target within a target apparatus; said apparatus having a jacket, including a plurality of water-cooling channels running there through, and a container comprised of Boron Nitride in the shape of a cylinder or a wedge;

directing an electron beam onto a bremsstrahlung converter in order to generate photons;

said electron beam having a beam energy of at least 30 MeV; and, irradiating said target with said photons in order to isotopically convert at least a portion of the target to copper-67.

* * * * *